US006886501B2

(12) United States Patent
Bosch et al.

(10) Patent No.: US 6,886,501 B2
(45) Date of Patent: May 3, 2005

(54) APPARATUS AND PROCESS FOR HEATING STEAM

(75) Inventors: Sjoerd Bosch, Amsterdam (NL); Franciscus Gerardus Van Dongen, Amsterdam (NL); Johannes Didericus De Graaf, Amsterdam (NL)

(73) Assignee: Shell Oil Company, Houston, TX (US)

( * ) Notice: Subject to any disclaimer, the term of this patent is extended or adjusted under 35 U.S.C. 154(b) by 22 days.

(21) Appl. No.: 10/477,607

(22) PCT Filed: May 15, 2002

(86) PCT No.: PCT/EP02/05382

§ 371 (c)(1),
(2), (4) Date: May 24, 2004

(87) PCT Pub. No.: WO02/093073

PCT Pub. Date: Nov. 21, 2002

(65) Prior Publication Data

US 2004/0187796 A1 Sep. 30, 2004

(30) Foreign Application Priority Data

May 17, 2001 (EP) ..... 01201864

(51) Int. Cl.[7] ..... F22B 33/12
(52) U.S. Cl. ..... 122/20 B; 122/483; 122/487
(58) Field of Search ..... 122/476, 482, 122/20 B, 30, 31.1, 15.1, 18.1, 450, 483, 487, 489, 488, 459, 466, 479.2, 477; 165/96, 140, 157, 299, 911

(56) References Cited

U.S. PATENT DOCUMENTS

| | | | | |
|---|---|---|---|---|
| 2,594,471 A | * | 4/1952 | Marshall | 165/145 |
| 3,769,941 A | * | 11/1973 | Dolezal | 122/406.1 |
| 4,184,322 A | | 1/1980 | Paull et al. | |
| 4,488,513 A | | 12/1984 | Jahnke et al. | |
| 4,589,473 A | | 5/1986 | Kehrer | |
| 5,307,766 A | | 5/1994 | Pearce | |
| 5,575,244 A | * | 11/1996 | Dethier | 122/406.1 |
| 5,771,963 A | * | 6/1998 | Blangetti et al. | 165/143 |

FOREIGN PATENT DOCUMENTS

| | | | |
|---|---|---|---|
| DE | 36 02 935 | 8/1987 | F28D/7/00 |
| DE | 199 26 402 | 11/2000 | F22B/1/18 |
| EP | 0 199 251 | 10/1986 | F22B/1/18 |
| EP | 0 257 719 | 3/1988 | F22B/1/18 |
| EP | 0 272 378 | 6/1988 | C07C/11/04 |
| EP | 0 285 297 | 10/1988 | F22G/5/00 |
| EP | 0 617 230 | 9/1994 | F22B/1/18 |
| GB | 756.919 | 9/1956 | |
| JP | 05 248604 | 9/1993 | F22G/5/12 |
| WO | 01/88435 | 11/2001 | F22B/1/18 |

* cited by examiner

*Primary Examiner*—Gregory A. Wilson
(74) *Attorney, Agent, or Firm*—Charles W. Stewart

(57) ABSTRACT

An apparatus for heating steam formed from cooling water in a heat exchanger for hot gas, having a super heater arranged in the heat exchanger vessel, a process for heating steam performed in such an apparatus, and a process for gasification of a hydrocarbonaceous feedstock having such a process for heating steam.

15 Claims, 2 Drawing Sheets

APPARATUS AND PROCESS FOR HEATING STEAM

FIELD OF THE INVENTION

The present invention relates to apparatus for heating steam.

BACKGROUND OF THE INVENTION

An apparatus is described in EP-A-257719. The apparatus disclosed in this publication consists of a submerged super heater module, consisting of a shell-tube heat exchanger, wherein the partially cooled gas is fed to the shell side of the super heater module and the steam to the tube side of the super heater module. The two flows are contacted in the super heater in a co-current mode of operation.

Applicants found that when the apparatus according to EP-A-257719 is used to cool gas comprising contaminants such as carbon, ash and/or sulphur, which is for example the case for synthesis gas produced by gasification of a gaseous or liquid hydrocarbonaceous feedstock, leakage can occur. It is believed that fouling of the apparatus at the gas side causes leakage. Although the apparatus was cleaned regularly the leakage problems persisted. Fouling, especially when the synthesis gas is produced by gasification of a liquid hydrocarbon, in particular heavy oil residues, will also result in that the heat exchange capacity of the apparatus will gradually decrease with run time. As a result, the temperature of the process gas leaving the heat exchanger will increase gradually with runtime. If the temperature of the process gas leaving the primary heat exchanger apparatus exceeds a certain temperature, typically 400–450° C., the temperature of the tubes that transmit the process gas downstream of the primary heat exchanger will be so high that they may be damaged. Therefore, the apparatus has to be shut down in order to clean the tubes. The runtime of an apparatus after which the tubes have to be cleaned is referred to as 'cycle time'.

SUMMARY OF THE INVENTION

It is an object of the present invention to provide for an apparatus for heating steam in a heat exchanger for cooling a hot gas wherein the cycle time is maximized and/or the leakage problems are avoided. The hot gas is especially a hot process gas comprising compounds, which cause fouling of the heat exchange surfaces of the apparatus. Such compounds are especially soot and, optionally, sulphur. Reference herein to soot is to carbon and ash.

This object has been met by an apparatus for heating steam formed from cooling water in a heat exchanger for hot gas, comprising a primary heat-exchanger vessel having a compartment for cooling water, an inlet for the gas to be cooled, an outlet for cooled gas, an outlet for heated steam and a collecting space for maintaining generated steam;

at least one primary evaporator tube positioned in the compartment for cooling water and fluidly connected to the inlet for the gas to be cooled, at least one steam tube for withdrawal of generated steam from the collecting space for maintaining generated steam via a steam outlet of said collecting space, at least one secondary tube-shell heat exchanger vessel, 'super heater module', positioned in the compartment for cooling water, wherein the generated steam is further heated against partially cooled gas from the primary evaporator tube, wherein the primary evaporator tube is fluidly connected to the tube side of the super heater module and the steam tube for withdrawal of generated steam is fluidly connected to the shell side of the super heater module such that heat exchange takes place substantially co-current; and a secondary evaporator tube positioned in the compartment for cooling water and fluidly connected to the gas outlet of the super heater module at one end and connected to the outlet for cooled gas at its downstream end.

DETAILED DESCRIPTION OF THE INVENTION

It has been found that the apparatus according to the invention has an increased cycle time, while problems with leakage are avoided. The increased cycle time is mainly achieved by the presence of the secondary evaporator tube. The heat exchanging area's of primary and secondary evaporator tubes are suitably designed such that, in the begin of run, almost no heat exchange takes place by the secondary evaporator tube. Due to fouling of the inside of the evaporator and super heater tubes during the run the gas temperature in the secondary evaporator tube will gradually increase. The secondary evaporator tubes will then gradually start to participate in the cooling of the gas, thereby extending the period after which the temperature at the outlet for cooled gas reaches the above referred to critical value.

Because the hot gas flows through the super heater module at the tube side a more easy to clean apparatus has furthermore been obtained. Cleaning can now be performed by for example passing a plug through the evaporator tubes and the tubes of the super heater, fluidly connected to said evaporator tube.

Because the steam and gas flow substantially co-current in the super heater module extreme high wall temperatures in the super heater module are avoided. A disadvantage is that the heat exchange efficiency is less than when a counter-current mode of operation had been chosen. However it has been found that a sufficient amount of super heated steam of acceptable temperature can be produced using the apparatus according to the invention.

Reference to an evaporator tube is to one or more parallel tubes. Preferably, in order to minimize the size of the equipment, the evaporator tubes are coiled.

The invention will now be illustrated in more detail with reference to the accompanying drawings.

Figure 1:
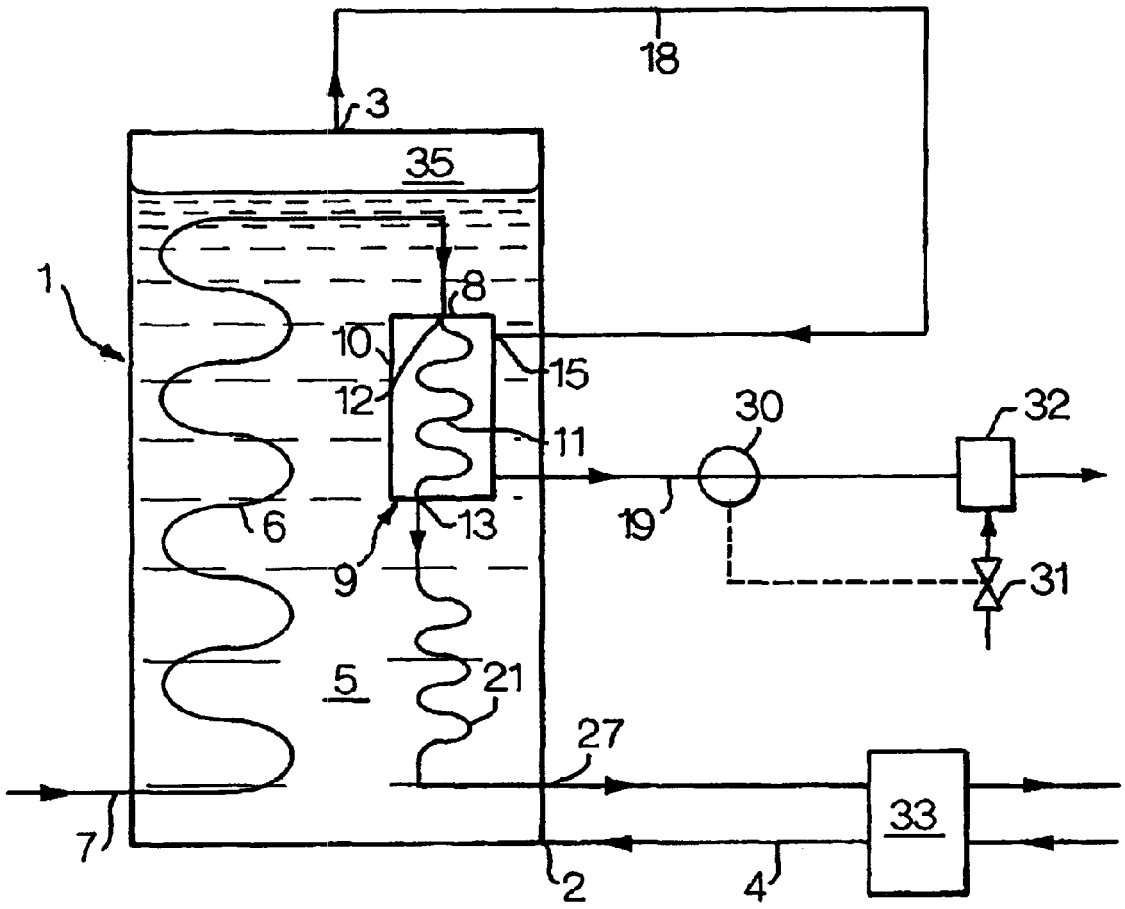
FIG. 1 shows schematically an apparatus according to the invention.
Figure 2:
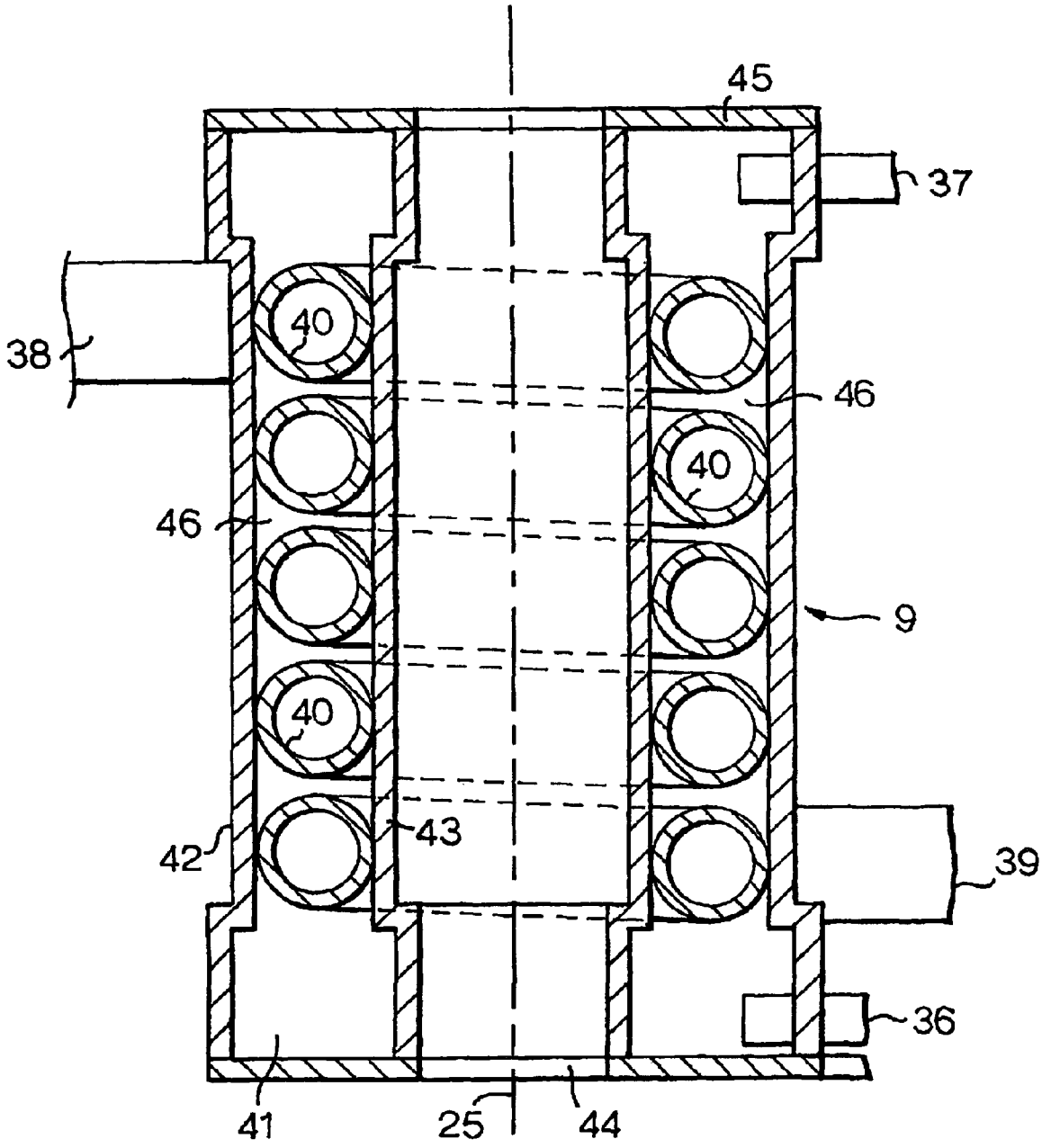
FIG. 2 shows a preferred super heater module.

Referring now to FIGS. 1 and 2, the apparatus according to the invention comprises a primary heat exchanger vessel 1 having an inlet 2 for cooling water, which inlet 2 opens into the interior of vessel 1. The vessel 1 further comprises a compartment for cooling water 5 and a collecting space 35 for maintaining generated steam. Collecting space 35 is provided with an outlet 3 fluidly connected to a steam tube 18 for withdrawal of generated steam. The steam tube 18 may be positioned inside or outside vessel 1. Additional means to withdraw steam, which steam is not further heated and used to heat other process streams, from collecting space 35 may be present. A suitable embodiment of how steam tube 18 may be positioned inside vessel 1 is illustrated by FIG. 1*a* of EP-A-257719. Preferably a mistmat (not shown) is present between outlet 3 and steam collecting space 35 in order to avoid water droplets from entering outlet 3. During normal operation, cooling water is supplied to vessel 1 via cooling water supply conduit 4, wherein the compartment for cooling water 5 of the vessel 1 is filled with cooling water. The apparatus comprises a primary evaporator tube bundle 6 having an inlet 7 for hot gas and an outlet 8. The primary evaporator tube bundle 6 is arranged in the compartment for cooling water 5. The apparatus further comprises a super heater module 9, comprising a vessel 10 containing a second tube bundle 11 having an inlet 12 communicating with the outlet 8 of the primary evaporator tube bundle 6 and an outlet 13. The shell side of super heater module 9 is fluidly connected to steam conduit 18 via steam inlet 15. Steam is heated in super heater module 9 and is discharged via steam outlet 17 to super heated steam conduit 19. Inlets 15 and 12 and outlets 17 and 13 are preferably arranged such that the hot gas and the steam flow substantially co-current through a, preferably elongated, super heater module 9. FIG. 2 will illustrate a suitable super heater module in more detail.

Thus, the apparatus comprises a flow path for steam, extending from the outlet 3 for steam of vessel 1, via the inlet 15 for steam of vessel 10, through the shell side 16 of super heater 9 to the outlet 17 for super heated steam. From the outlet 17, the super heated steam is discharged via conduit 19.

From outlet 13 of super heater module 9, the cooled gas is discharged to secondary evaporator tube 21. Secondary evaporator tube 21 is further fluidly connected to the outlet for cooled gas 27.

During normal operation, the temperature of the gas in the gas discharge conduit downstream of vessel 1, i.e. conduit 27, will gradually increase for a given throughput of hot gas, due to fouling of the primary and secondary evaporator and super heater tube bundles. In time the secondary evaporator tube will increasingly contribute to the cooling of the hot gas because the temperature of the gas entering the secondary evaporator tube increases in time. By choosing a sufficiently high heat exchanging area for the secondary evaporator tube the temperature of the gas leaving the apparatus via outlet 27 can be kept below suitably 450° C. Preferably the surface area of the secondary evaporator tube is at least 50% of the surface area of the primary evaporator tube. More preferably the surface area of the secondary evaporator tube is at least 75%, and most preferably more than 100%, of the surface area of the primary evaporator tube.

A temperature-measuring device 28 may determine the temperature of the gas flowing in conduit 27 at a point just downstream of vessel 1.

The temperature of the super heated steam discharged from the apparatus according to the present invention may be regulated by the addition of water. This reduces the temperature of the steam and simultaneously increases the amount of produced steam. FIG. 1 shows a preferred embodiment of how water can be added. As shown in FIG. 1, the temperature of the super heated steam discharged via conduit 19 is determined by means of a temperature measuring device 30. The measured data are fed to a control unit (not shown), which is controlling by means of valve 31 the amount of water added to conduit 19 by quench 32.

Preferably, the cooled gas in gas discharge conduit 27 is further cooled by heat exchange with the cooling water before it is entering the vessel 1. Therefore, the apparatus according to the invention preferably comprises an auxiliary heat exchanger 33 for cooling gas against cooling water.

FIG. 2 shows a preferred super heater module 9 with an inlet 36 for steam, and outlet 37 for heated steam, an inlet 38 for hot gas and an outlet 39 for hot gas. The inlet 38 for hot gas is fluidly connected to a coiled tube 40. Coiled tube 40 is positioned in an annular space 41 formed by tubular outer wall 42 and tubular inner wall 43 and bottom 44 and roof 45. Tubular walls 42 and 43 are positioned against coiled tube 40 such that at the exterior of the coiled tube and within the annular space 41 a spiral formed space 46 is formed. This spiral formed space 46 is fluidly connected at one end to steam inlet 36 and at its opposite end with steam outlet 37. Due to this configuration steam will flow via spiral space 46 co-current with the hot gas, which flows via coiled tube 40. For reasons of clarity only one coil 40 and one spiral space 46 is shown in FIG. 3. It will be clear that more than one parallel positioned coils and spirals can be placed in annular space 41.

One vessel 1 may comprise more than one super heater module 9, suitably from one to five. The super heater module 9 as shown in FIG. 2 may be connected with a downcomer (not shown). The downcomer enables water to flow to the lower end of vessel 1. Suitably tubular inner wall 43 of said downcomer is connected to said super heater module(s) 9 to enable water to flow downwards.

The apparatus according to the present invention is suitable for use in a process for super heating steam in a heat exchanger for cooling hot gas, preferably hot gas that is contaminated with mainly soot and/or sulphur. The process is particularly suitable for the cooling of soot- and sulphur-containing synthesis gas produced by means of gasification of liquid or gaseous hydrocarbonaceous feedstocks, preferably a heavy oil residue, i.e. a liquid hydrocarbonaceous feedstock comprising at least 90% by weight of components having a boiling point above 360° C., such as visbreaker residue, asphalt, and vacuum flashed cracked residue. Synthesis gas produced from heavy oil residue typically comprises 0.1 to 1.5% by weight of soot and 0.1 to 4% by weight of sulphur.

Due to the presence of soot and sulphur, fouling of the tubes transmitting the hot gas will occur and will increase with runtime, thereby impairing the heat exchange in the heat exchanger and the super heater.

The hot gas to be cooled in the process according to the invention has typically a temperature in the range of from 1200 to 1500° C., preferably 1250 to 1400° C., and is preferably cooled to a temperature in the range of from 150 to 450° C., more preferably of from 170 to 300° C.

At least part of the super heated steam produced in the process according to the invention may advantageously be used in a process for the gasification of a hydrocarbonaceous feedstock. In such gasification processes, which are known in the art, hydrocarbonaceous feedstock, molecular oxygen and steam are fed to a gasifier and converted into hot synthesis gas. Thus, the present invention further relates to a process for gasification of a hydrocarbonaceous feedstock comprising the steps of (a) feeding the hydrocarbonaceous feedstock, a molecular oxygen-containing gas and steam to a gasification reactor, (b) gasifying the feedstock, the molecular oxygen-containing gas, and the steam to obtain a hot synthesis gas in the gasification reactor, (c) cooling the hot synthesis gas obtained in step (b) and heating steam accordingly in an apparatus as hereinbefore defined, wherein at least part of the steam fed to the gasification reactor in step (a) is obtained in step (c).

We claim:

1. An apparatus for heating steam formed from cooling water in a heat exchanger for hot gas, comprising a primary heat-exchanger vessel having a compartment for cooling water, an inlet for the gas to be cooled, an outlet for cooled gas, an outlet for heated steam and a collecting space for maintaining generated steam;

at least one primary evaporator tube positioned in the compartment for cooling water and fluidly connected to the inlet for the gas to be cooled;

at least one steam tube for withdrawal of generated steam from the collecting space for maintaining generated steam via a steam outlet of said collecting space;

at least one secondary tube-shell heat exchanger vessel, 'super heater module', positioned in the compartment for cooling water, wherein the generated steam is further heated against partially cooled gas from the primary evaporator tube;

wherein the primary evaporator tube is fluidly connected to the tube side of the super heater module and the steam tube for withdrawal of generated steam is fluidly connected to the shell side of the super heater module such that heat exchange takes place substantially co-current; and a secondary evaporator tube positioned in the compartment for cooling water and fluidly connected to the gas outlet of the super heater module at one end and connected to the outlet for cooled gas at its downstream end.

2. The process for heating steam performed in an apparatus according to claim 1.

3. The process according to claim 2, wherein the surface area's of the primary and secondary evaporator tubes are chosen such that the temperature at the outlet for cooled gas can be maintained below 450° C. for a prolonged period of time.

4. The process according to claim 3, wherein the hot gas is synthesis gas produced by gasification of a liquid or gaseous hydrocarbonaceous feedstock.

5. The process according to claim 4, wherein synthesis gas is produced by gasification of a liquid hydrocarbonaceous feedstock comprising at least 90% by weight of hydrocarbonaceous components having a boiling point above 360° C.

6. The process according to claim 5, wherein the hot gas comprises at least 0.05% by weight of soot.

7. The process according to claim 6, wherein the hot gas comprises at least 0.1% by weight of sulphur.

8. The process according to claim 7, wherein the gas is cooled from a temperature in the range of from 1200 to 1500° C., to a temperature in the range of from 150 to 450° C.

9. The process according to claim 6, wherein the gas is cooled from a temperature in the range of from 1200 to 1500° C., to a temperature in the range of from 150 to 450° C.

10. The process according to claims 5, wherein the hot gas comprises at least 0.1% by weight of sulphur.

11. The process according to claim 5, wherein the gas is cooled from a temperature in the range of from 1200 to 1500° C., to a temperature in the range of from 150 to 450° C.

12. The process according to claim 4, wherein the gas is cooled from a temperature in the range of from 1200 to 1500° C., to a temperature in the range of from 150 to 450° C.

13. The process according to claim 3, wherein the gas is cooled from a temperature in the range of from 1200 to 1500° C., to a temperature in the range of from 150 to 450° C.

14. The process according to claim 2, wherein the hot gas is synthesis gas produced by gasification of a liquid or gaseous hydrocarbonaceous feedstock.

15. The process according to claim 2, wherein the gas is cooled from a temperature in the range of from 1200 to 1500° C., to a temperature in the range of from 150 to 450° C.

* * * * *